US006820966B1

(12) United States Patent
Drury et al.

(10) Patent No.: US 6,820,966 B1
(45) Date of Patent: Nov. 23, 2004

(54) DROPLET DEPOSITION APPARATUS

(75) Inventors: Paul Raymond Drury, Herts (GB); Robert Alan Harvey, Cambridge (GB); Howard John Manning, Edinburgh (GB); Salhadin Omer, Cambridge (GB); Stephen Temple, Impington (GB); Jerzy Marcin Zaba, Histon (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 09/426,087

(22) Filed: Oct. 22, 1999

Related U.S. Application Data

(60) Provisional application No. 60/118,574, filed on Feb. 5, 1999.

(30) Foreign Application Priority Data

Oct. 24, 1998 (GB) ..... 9823264

(51) Int. Cl.[7] ..... B41J 2/05
(52) U.S. Cl. ..... 347/57

(56) References Cited

U.S. PATENT DOCUMENTS

| | | | | | |
|---|---|---|---|---|---|
| 3,930,260 | A | * | 12/1975 | Sicking | 222/420 |
| 4,491,851 | A | * | 1/1985 | Mizuno et al. | 347/11 |
| 4,601,777 | A | | 7/1986 | Hawkins et al. | 156/626 |
| RE32,572 | E | | 1/1988 | Hawkins et al. | 156/626 |
| 4,774,630 | A | | 9/1988 | Reisman et al. | 361/383 |
| 4,789,425 | A | | 12/1988 | Drake et al. | 156/644 |
| 4,851,371 | A | | 7/1989 | Fisher et al. | 437/226 |
| 4,896,172 | A | | 1/1990 | Nozawa et al. | 346/140 R |
| 4,935,750 | A | | 6/1990 | Hawkins | 346/140 R |
| 5,017,941 | A | | 5/1991 | Drake | 346/1.1 |
| 5,057,854 | A | | 10/1991 | Pond et al. | 346/140 R |
| 5,065,170 | A | | 11/1991 | Rezanka et al. | 346/140 R |
| 5,084,713 | A | | 1/1992 | Wong | 346/1.1 |
| 5,160,945 | A | | 11/1992 | Drake | 346/140 R |
| 5,459,498 | A | | 10/1995 | Seccombe et al. | 347/18 |
| 5,528,272 | A | | 6/1996 | Quinn et al. | |
| 5,657,061 | A | | 8/1997 | Seccombe et al. | 347/18 |
| 5,734,394 | A | | 3/1998 | Hackleman | |
| 5,815,185 | A | | 9/1998 | Pietrzyk | 347/92 |
| 5,850,234 | A | | 12/1998 | Kneezel et al. | 347/18 |
| 5,896,153 | A | * | 4/1999 | Swanson et al. | 347/87 |
| 5,976,303 | A | * | 11/1999 | Aoki | 156/308.2 |
| 6,168,263 | B1 | * | 1/2001 | Nojima et al. | 347/54 |
| 6,171,875 | B1 | * | 1/2001 | Silverbrook | 347/1 |
| 6,290,334 | B1 | * | 9/2001 | Ishinaga et al. | 347/12 |
| 6,582,066 | B1 | * | 6/2003 | Temple | 347/68 |

FOREIGN PATENT DOCUMENTS

| | | | | |
|---|---|---|---|---|
| EP | 0 197 723 A2 | | 10/1986 | |
| EP | 0 277 703 | * | 10/1988 | 310/311 |
| EP | 0 352 726 A2 | | 1/1990 | |
| EP | 0 498 292 A2 | | 8/1992 | |
| EP | 0 512 799 A2 | | 11/1992 | |

(List continued on next page.)

OTHER PUBLICATIONS

Hiroyuki, Printing Machine, Mar. 19, 1996, English language abstract for Japanese language document 8–72249.

(List continued on next page.)

*Primary Examiner*—K. Feggins
(74) *Attorney, Agent, or Firm*—Marshall, Gerstein & Borun LLP

(57) ABSTRACT

Droplet deposition apparatus comprises a fluid chamber comprising an actuator actuable by electrical signals to effect ejection of droplets from the fluid chamber, a drive circuit for supplying the electrical signals; and a conduit for supplying droplet fluid to said fluid chamber, the drive circuit being in substantial thermal contact with the conduit so as to transfer a substantial part of the heat generated in the drive circuit to the droplet fluid.

17 Claims, 6 Drawing Sheets

FOREIGN PATENT DOCUMENTS

| | | | |
|---|---|---|---|
| EP | 0 564 102 | A2 | 10/1993 |
| EP | 0 575 983 | A2 | 12/1993 |
| EP | 0 666 174 | A2 | 8/1995 |
| EP | 0 666 177 | A2 | 8/1995 |
| JP | 63-064757 | | 3/1988 |
| JP | 5-338171 | | 5/1993 |
| JP | 95-304168 | | 11/1995 |
| JP | 8-72249 | | 8/1996 |
| JP | 09-076485 | | 3/1997 |
| JP | 9-323415 | | 9/1997 |
| JP | 09-323414 | | 12/1997 |
| JP | 09-323415 | | 12/1997 |

OTHER PUBLICATIONS

Kia, Bubble Jet Print Device, Dec. 21, 1993, English language abstract for Japanese language document 5–338171.

Shiyuuhei, Ink Jet Recording Apparatus, Dec. 16, 1997, English language abstract for Japanese language document 9–323415.

International Search Report for PCT/GB99/03505 dated Jan. 21, 2000.

* cited by examiner

DROPLET DEPOSITION APPARATUS

This application claims the priority benefit under 35 U.S.C. § 119(e) of U.S. provisional application No. 60/118,574 filed Feb. 5, 1999, the entire disclosure of which is incorporated herein by reference.

BACKGROUND OF THE INVENTION

1. Field of the Invention

The present invention relates to droplet deposition apparatus, such as, for example, ink jet printheads.

2. Description of the Related Art

The current drive in drop-on-demand inkjet printing towards higher resolution requires increased density both of ink ejection nozzles and the associated drive circuitry. However, the increased density of the drive circuitry can lead to problems associated with overheating. Similarly, the trend towards ever greater printhead widths places correspondingly greater demands on heat management within printheads. Thermal ("bubble jet") printheads benefit in this regard from having their drive circuitry in close contact with the ink, which has a cooling effect. This is offset, however, by the need for special measures to maintain the electrical integrity of the circuitry in the ink environment.

SUMMARY OF THE INVENTION

It is an object of at least the preferred embodiments of the present invention to prevent, in a simple manner, the drive circuitry of a printhead from overheating without at the same time risking its electrical integrity.

In a first aspect the present invention provides droplet deposition apparatus comprising:

- a fluid chamber having actuator means actuable by electrical signals to effect ejection of droplets from the fluid chamber;
- drive circuit means for supplying the electrical signals to the actuator means; and
- conduit means for conveying droplet fluid to or from said fluid chamber;
- the drive circuit means being in substantial thermal contact with said conduit means so as to transfer a substantial part of the heat generated in said drive circuit to the droplet fluid.

Arranging the drive circuit means in such a manner can conveniently allow the ink in the printhead to serve as the sink for the heat generated in the drive circuitry. This can substantially reduce the likelihood of overheating, whilst avoiding the problems with electrical integrity that might occur were the integrated circuit packaging containing the circuitry allowed to come into direct contact with the ink.

The apparatus may comprise first conduit means for supplying droplet fluid to said fluid chamber and second conduit means for leading droplet fluid from said fluid chamber. If so, the drive circuit means may advantageously be thermally connected to the second conduit means. This can provide the most direct route out of the printhead for the heat generated in the chip of the drive circuit and, in the event that the heat produced by the chip varies significantly during operation, can minimise any variation in the temperature of the ink in the fluid chamber itself. As is known, for example, from WO97/35167, such temperature variation can give rise to variations in droplet ejection velocity and consequent dot placement errors in the printed image.

Where the drive circuit is incorporated within an integrated circuit package of substantially cuboid form in which at least some of the faces are rectangles each having a surface area, a face other than that face having the smallest surface area may advantageously be arranged so as to lie substantially parallel to the direction of fluid flow in that part of the conduit closest to said face, and to be in substantial thermal contact with the fluid. Such an arrangement can ensure significant heat transfer to the droplet fluid. Preferably, that face having the greatest surface area is arranged so as to lie parallel to the direction of fluid flow. Circuit architecture permitting, such an arrangement can maximise heat transfer from the circuitry.

A second aspect of the present invention provides droplet deposition apparatus comprising:

- at least one droplet election unit comprising a plurality of fluid chambers, actuator means and a plurality of nozzles arranged in a row, said actuator means being actuable to eject a droplet of fluid from a fluid chamber through a respective nozzle; and
- a support member for said at least one droplet ejection unit, said support member comprising at least one droplet fluid passageway communicating with said plurality of fluid chambers and arranged so as to convey droplet fluid to or from said fluid chambers in a direction substantially parallel to said nozzle row and to transfer a substantial part of the heat generated during droplet ejection to said conveyed droplet fluid.

This can provide for substantially even distribution of heat along the length of the support member, which can lead to reduced thermally-induced strains that might otherwise distort the printhead. Such distortion would become more pronounced as the width of the printhead increased, for example, to that of a page (typically 12.6 inches. (32 cm) for the American "Foolscap" standard) and would occur regardless of whether a plurality of narrow ejection units or a single wide ejection unit were used in conjunction with the support member.

Advantageously, the droplet fluid passageway may occupy the majority of the area of the support member when viewed in cross-section. Alternatively or in addition, the passageway may comprise respective portions for the flow of droplet fluid in to and out of each fluid chamber. Such flow can aid the transfer of heat from the fluid chamber (where the main source of heat—the actuator means—is located) to the remainder of the support, thereby reducing temperature differentials.

To provide effective support for the at least one droplet ejection unit, the cross-section of support member is preferably wider in the direction of ink ejection from the nozzles than in the direction of the nozzle row.

In one embodiment, the apparatus comprises a plurality of said droplet ejection units, the support member supporting the droplet ejection units side by side in the direction of the nozzle rows, the support member comprising at least one droplet fluid passageway communicating with at least two of said ejection units and arranged so as to convey droplet fluid to or from said ejection units in a direction substantially parallel to said nozzle rows and to transfer a substantial part of the heat generated during droplet ejection to said conveyed droplet fluid.

Heat distribution may be facilitated by constructing the support member from a material—such as aluminium—having a high thermal conductivity. Such a material also has advantages as regards manufacture and cost. Problems arise, however, where the ejection unit is made from material having a coefficient of thermal expansion that is significantly different to that of the support. This will be the case with an ejection unit comprising channels formed in a body of piezoelectric material (typically lead zirconium titanate, PZT) described hereafter. As will be readily appreciated, differential expansion—particularly in the direction of the nozzle row in a "pagewide" device—may lead to distortion and/or breakage of ink seals, actuator components, electrical contacts, etc.

Therefore, it is preferable to provide means for attaching said at least one droplet ejection unit to the support member in order to substantially avoid transferral of thermal deformation of the support member to said at least one droplet ejection unit.

A third aspect of the present invention provides droplet deposition apparatus comprising:

a fluid chamber, at least part of which is formed from a first material having a first coefficient of thermal expansion, said chamber being associated with actuator means actuable to eject a droplet from the chamber and having a port for the inlet of droplet fluid thereto;

a support member for said fluid chamber and including a passageway for supply of droplet liquid to said port, the support member being defined at least in part by a second material having a second coefficient of thermal expansion greater than said first coefficient; and means for attaching the fluid chamber to the support member in order to substantially avoid transfer of thermal deformation of the support member to said fluid chamber.

Preferably, the attachment means comprises resilient bonding means for bonding the or each fluid chamber to the support member. In an example described hereafter, an adhesive rubber pad is used to bond a support member of extruded aluminium to a fluid chamber structure comprising a channel formed in a body of PZT and closed by cover member of a material, such as molybdenum, that is thermally matched to the PZT. Forming ink supply ports in the cover and ink ejection nozzles in the channelled component can provide a particularly compact design having a low component count.

Further advantageous embodiments of the invention are set out in the description, drawings and dependent claims.

BRIEF DESCRIPTION OF THE DRAWINGS

The invention will now be described by way of example by reference to the following diagrams, in which.

DETAILED DESCRIPTION OF THE PREFERRED EMBODIMENTS

Figure 1:
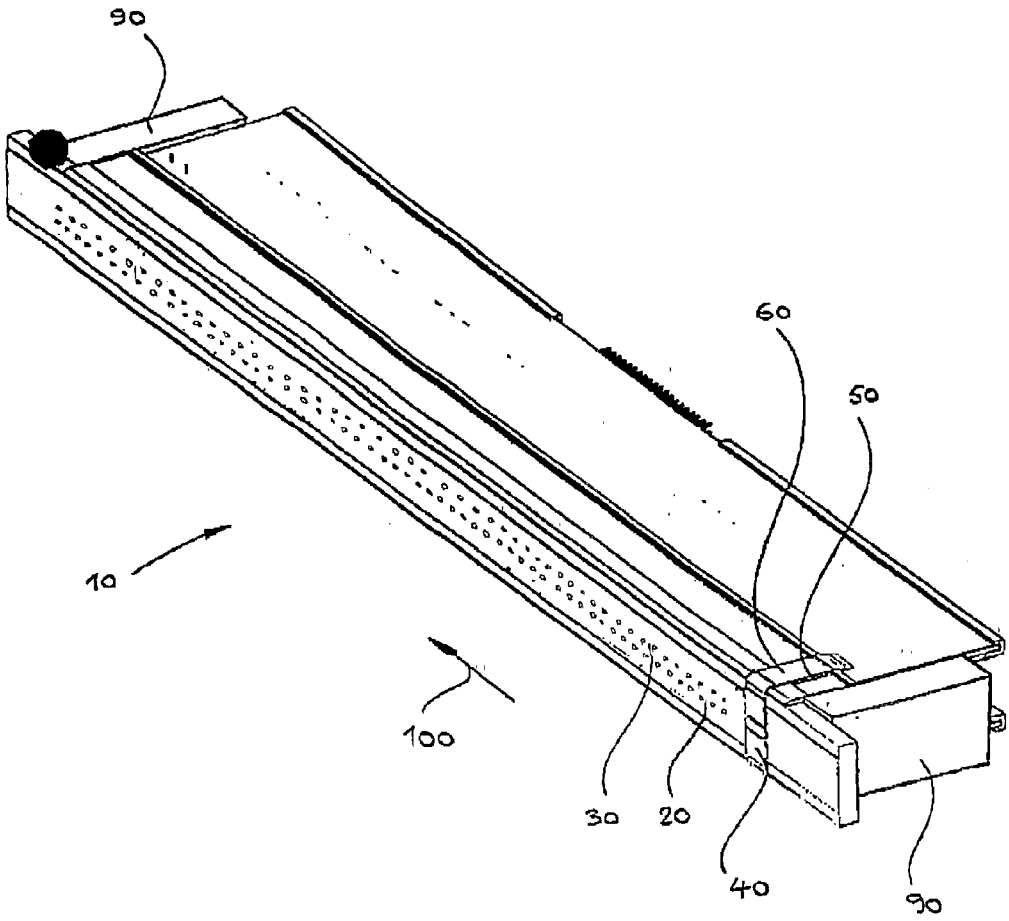
FIG. 1 is a perspective view from the front and top of a first embodiment of the invention.

FIG. 1 illustrates a first embodiment of droplet deposition apparatus embodied by a printhead 10. The embodiment shown is a "pagewide" device, having two rows of nozzles 20,30 that extend (in the direction indicated by arrow 100) the width of a piece of paper, which allows ink to be deposited across the entire width of a page in a single pass. Ejection of ink from a nozzle is achieved by the application of an electrical signal to actuation means associated with a fluid chamber communicating with that nozzle, as is known e.g. from EP-A-0 277 703, EP-A-0 278 590 and, more particularly, UK application numbers 9710530 and 9721555 incorporated herein by reference. To simplify manufacture and increase yield, the "pagewide" rows of nozzles are made up of a number of modules, one of which is shown at 40. Each module has associated fluid chambers and actuation means and is connected to associated drive circuitry (integrated circuit ("chip") 50) by means e.g. of a flexible circuit 60. Ink supply to and from the printhead is via respective bores (not shown) in endcaps 90.

Figure 2:
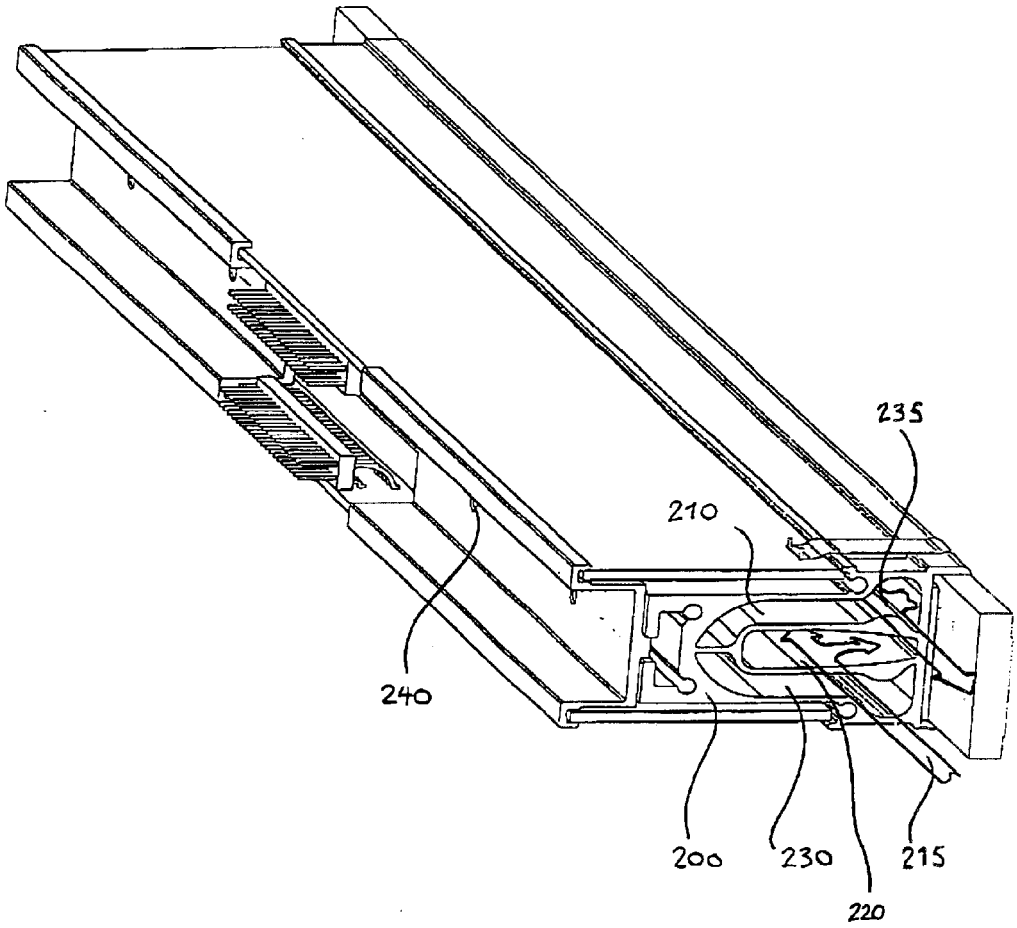
FIG. 2 is a perspective view from the rear and top of the printhead of FIG. 1.
Figure 3:
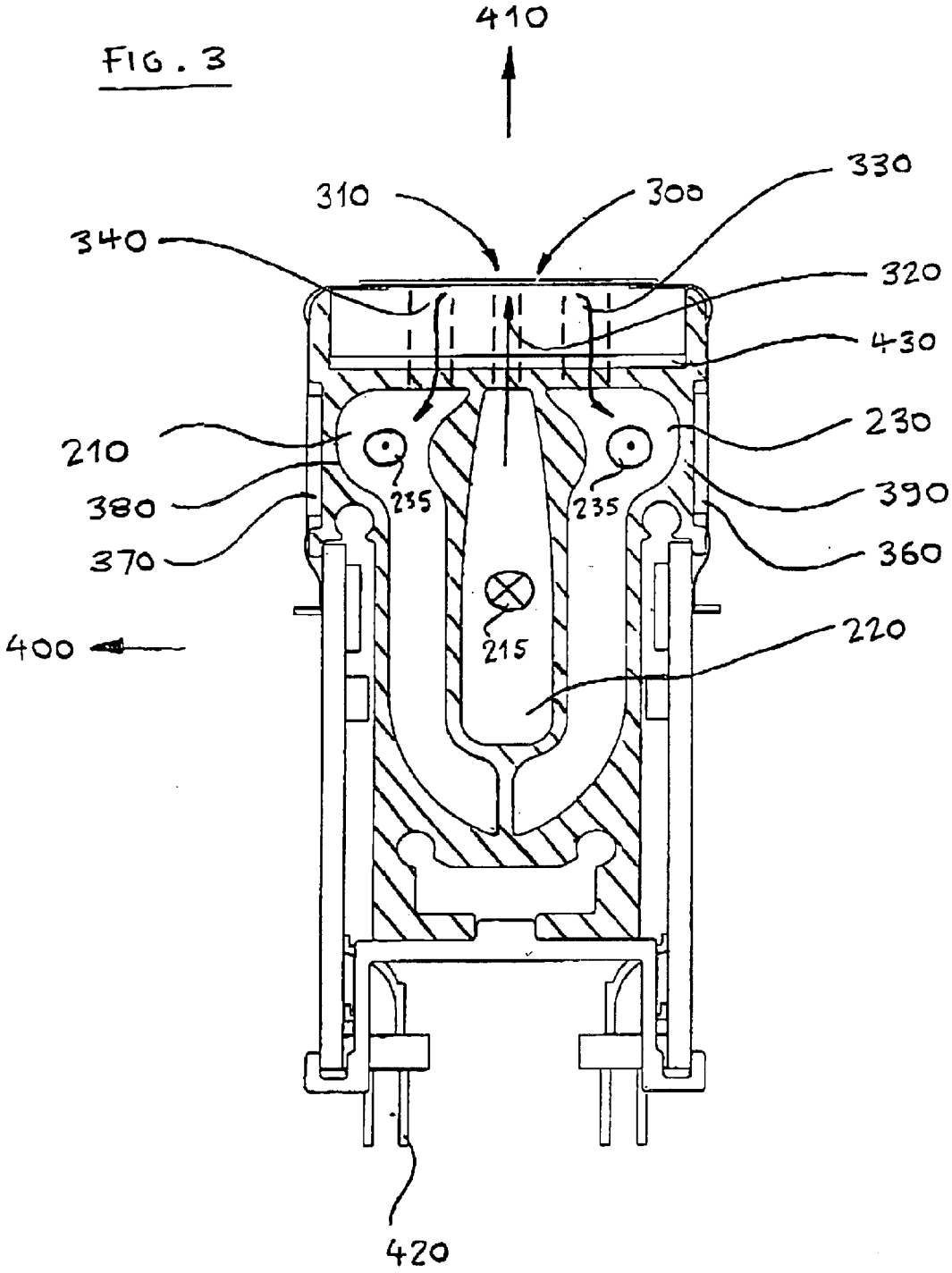
FIG. 3 is a sectional view of the printhead taken perpendicular to the direction of extension of the nozzle rows.

FIG. 2 is a perspective view of the printhead of FIG. 1 from the rear and with endcaps 90 removed to reveal the supporting structure 200 of the printhead incorporating ink flow passages 210,220,230 extending the width of the printhead. Via a bore in one of the endcaps 90 (omitted from the views of FIGS. 2 and 3), ink enters the printhead and the ink supply passage 220, as shown at 215 in FIG. 2. As it flows along the passage, it is drawn off into respective ink chambers, as illustrated in FIG. 3, which is a sectional view of the printhead taken perpendicular to the direction of extension of the nozzle rows. From passage 220, ink flows into first and second parallel rows of ink chambers (indicated at 300 and 310 respectively) via aperture 320 formed in structure 200 (shown shaded). Having flowed through the first and second rows of ink chambers, ink exits via apertures 330 and 340 to join the ink flow along respective first and second ink outlet passages 210,230, as indicated at 235. These join at a common ink outlet (not shown) formed in the endcap located at the opposite end of the printhead to that in which the inlet bore is formed.

Each row of chambers 300 and 310 has associated therewith respective drive circuits 360, 370. The drive circuits are mounted in substantial thermal contact with that part of structure 200 acting as a conduit and which defines the ink flow passageways so as to allow a substantial amount of the heat generated by the circuits during their operation to transfer via the conduit structure to the ink. To this end, the structure 200 of the embodiment of FIGS. 1–3 is made of a material having good thermal conduction properties. Of such materials, aluminium is particularly preferred on the grounds that it can be easily and cheaply formed by extrusion. Circuits 360,370 are then positioned on the outside surface of the structure 200 so as to lie in thermal contact with the structure, thermally conductive pads or adhesive being optionally employed to reduce resistance to heat transfer between circuit and structure.

In the embodiment shown, the cuboid drive circuit dies 360,370 are arranged such that a largest (rectangular or square) surface of each die lies substantially parallel to the direction (indicated at 235) of fluid flow in the respective parts of the conduits 210,230 lying closest to those surfaces. This helps maximise heat transfer between circuit and ink, which is also facilitated by minimising the thickness of the structure separating the ink channel and the circuit, as well as by making the structure of a material having good thermal conduction.

Figure 4:
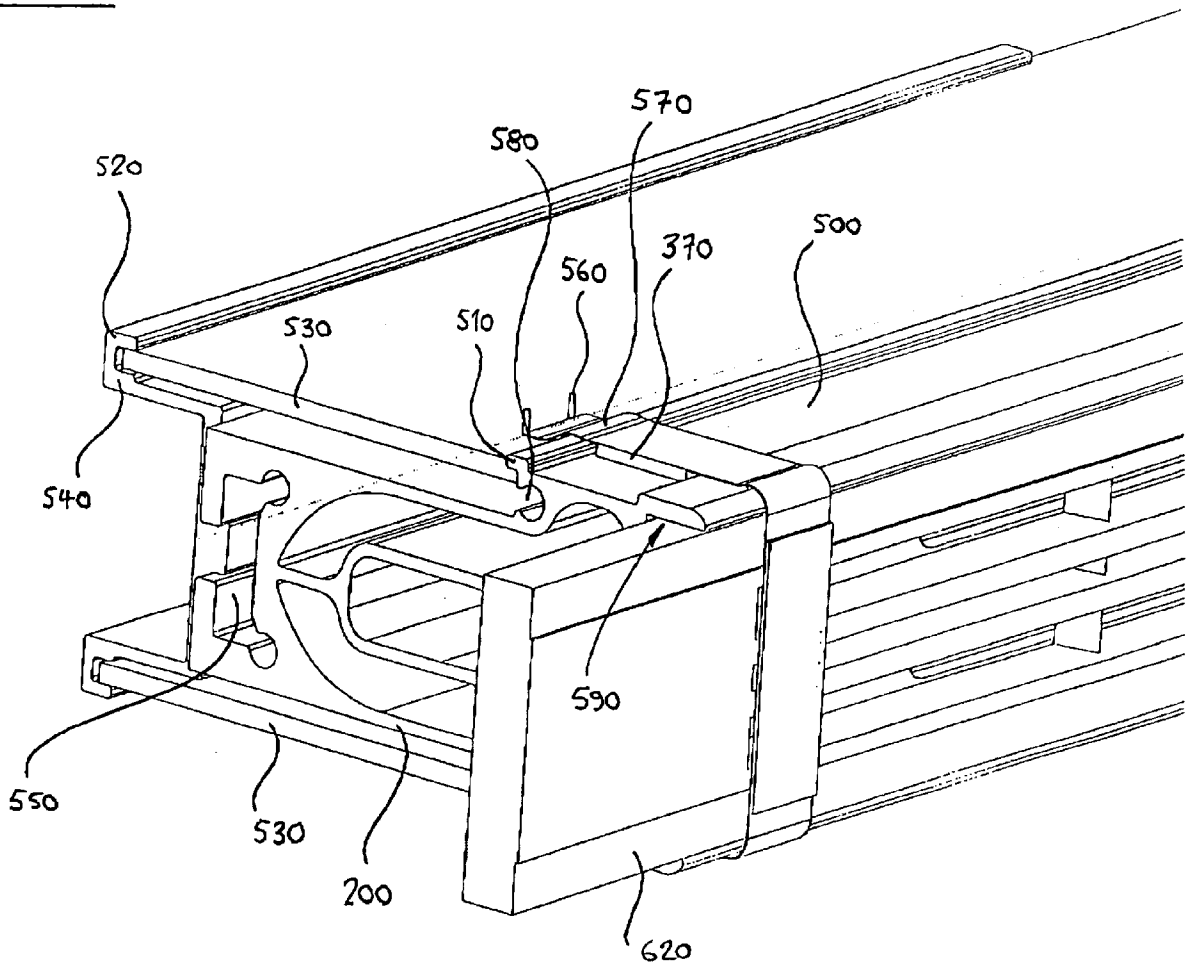
FIG. 4 is a perspective view from the top and above of one end of the printhead of FIG. 1.

Reference is now made to FIG. 4, which is a perspective view from the top and above of one end of the printhead with all but one of the modules 40 having been removed to show external and internal details of structure 200 more clearly. The structure includes recesses 500 to accommodate drive circuits 370 and lips 510,520 to retain further circuit boards 530 populated with those components not suited to incorporation into the drive circuits 370. Forming rear lip 520 on a separate component 540, as shown in FIG. 4, allows these boards to be clamped into place by the action of fastening means, for example screws inserted through holes 240 shown in FIG. 2 and engaging with a bar (not shown) residing in channel 550. Preferably the bar is made of a strong material, such as steel, able to accommodate screw threads and reinforce aluminium structure 200, particularly against the forces generated when installing and connecting the printhead.

In the present embodiment, further circuit board is also formed with pins (FIG. 3, 420) for supply of power and data into the printhead and with posts 560 for supplying power and data—suitably processed—to the drive circuits 370 via flexible connectors 570. Such connection techniques are well known in the art and will not therefore be discussed in further detail.

As explained above, heat generated in the drive circuits is transferred to the ink whence it is distributed about the structure 200 as a result of the aforementioned ink flow paths. Heat generated in the ink chambers by the associated actuator means is also distributed in this manner. As a result, any temperature differentials that arise within structure 200 are small and do not give rise to significant internal forces and/or distortion.

However, the overall warming of the printhead during operation may lead to differential expansion of the structure 200 and the body in which the fluid chambers 300,310 are formed where these two members are of materials having significantly differing coefficients of thermal expansion, $C_{TE}$. This is the case in the present embodiment having fluid chambers formed in a body of piezoelectric material in accordance with the aforementioned UK application number 9721555.

Figure 5:
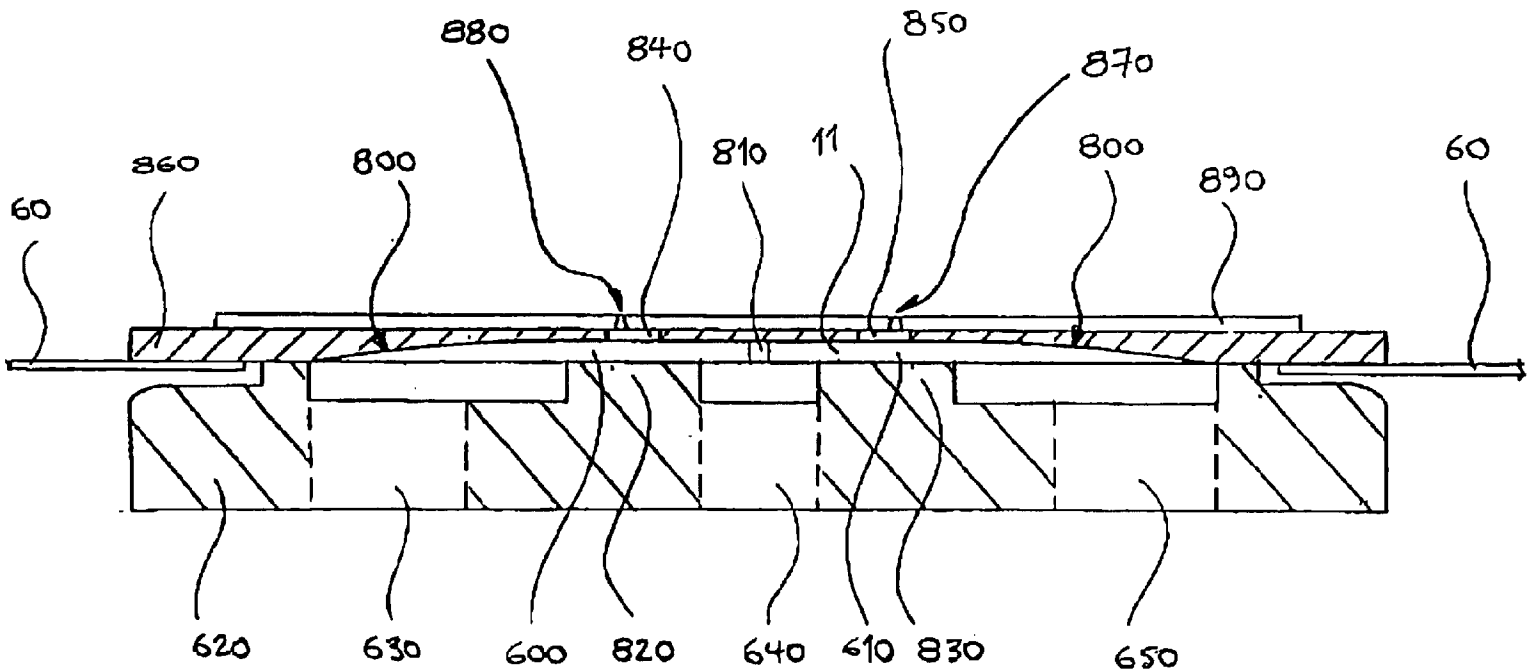
FIG. 5 is a sectional view taken along a fluid channel of an ink ejection module of the printhead of FIG. 1.

As illustrated in FIG. 5, which is a sectional view taken along a fluid channel of a module 40, channels 11 are formed in a base component 860 of piezoelectric material so as to define piezoelectric channel walls therebetween. These walls are subsequently coated with electrodes to form channel wall actuators as are known e.g. from the aforementioned EP-0-0 277 703, a break in the electrodes at 810 allowing the channel walls in either half of the channel to be operated independently by means of electrical signals applied via electrical inputs (flexible circuits 60).

Each channel half is closed along a length 600,610 by respective sections 820,830 of a cover component 620 which is also formed with ports 630,640,650 that allow ink to be supplied to and from each channel half for cleaning and heat removal purposes, as is generally known. As is also known, cover component 620 is preferably made of a material that is thermally matched to the piezoelectric material of the channelled component. Ink ejection from each channel half is via openings 840,850 that communicate the channel with the opposite surface of the piezoelectric base component to that in which the channel is formed. Nozzles 870,880 for ink ejection are subsequently formed in a nozzle plate 890 attached to the piezoelectric component.

To avoid the distortion of the printhead that might otherwise occur as a result of the differing thermal expansion characteristics of the piezoelectric material of the fluid chambers and the aluminium of the structure 200, tie rods may be inserted in bores 580 in the structure and tightened so as to keep structure 200 in compression. Although any material having a value of $C_{TE}$ less than that of the structure—steel in the case of an aluminium structure—is suitable for the tie rods, it will be appreciated that low values of $C_{TE}$ are to be preferred.

In addition, cover component 620 may be attached to structure 200 by means of a resilient bond—adhesive coated rubber is shown at 430 in FIG. 3—so as to allow any relative expansion that may occur in spite of the presence of tie rods (and which may be of the order of 0.3 mm over a typical 12.6" (32 cm) length of a printhead) to take place at this less critical interface rather than generating stresses and deformations in the printhead module 40 itself. As shown in FIG. 4, cover 620 may be sat in a well 590 formed in structure 200 and may additionally extend to either side of the printhead to provide mounting surfaces for the printhead. Molybdenum, which has high strength and thermal conductivity in addition to being thermally matched to PZT, has been found to be a particularly suitable material for the cover.

Figure 6:
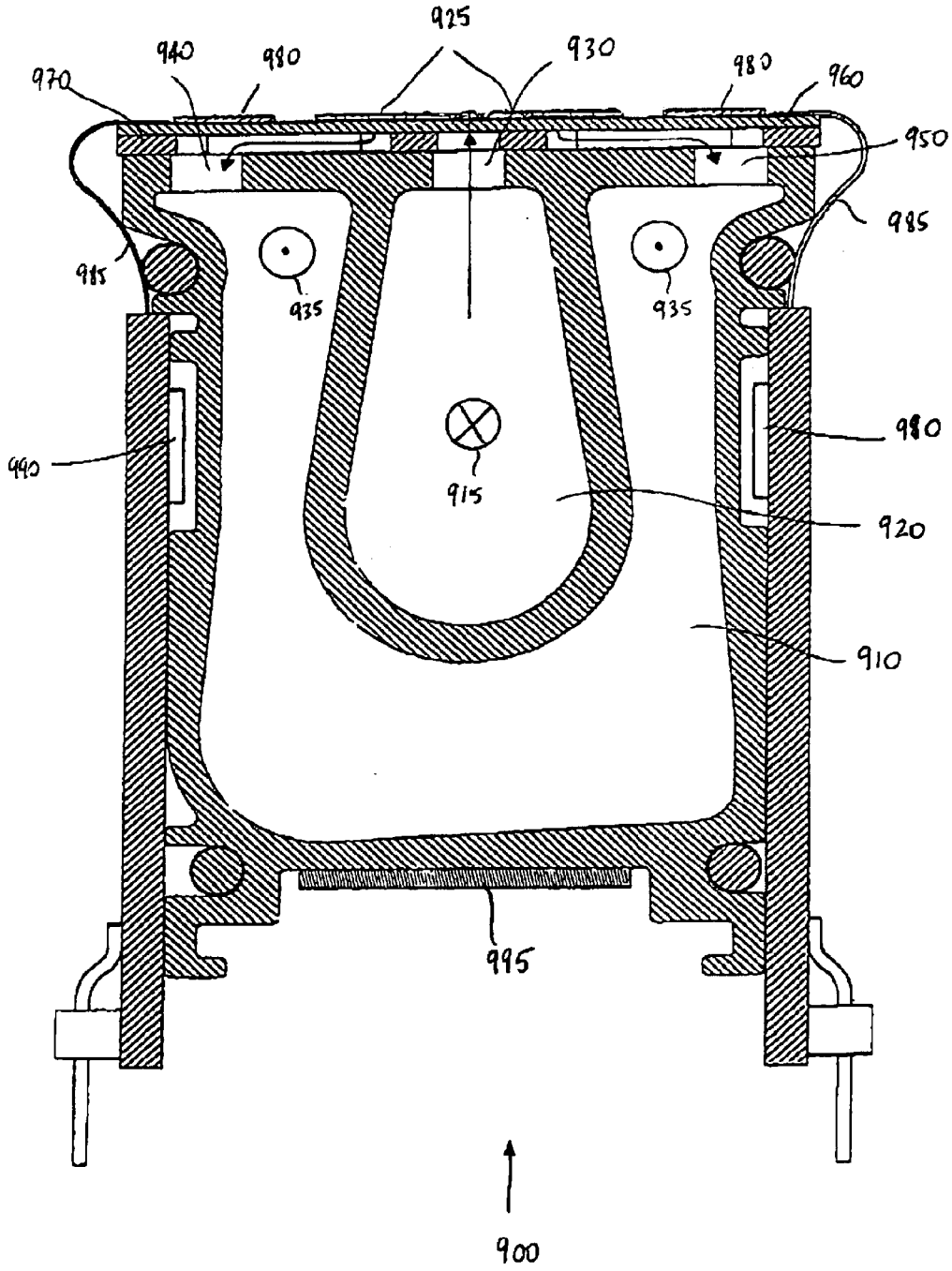
FIG. 6 is a sectional view of a second embodiment of droplet deposition apparatus taken perpendicular to the direction of extension of the nozzle rows.

FIG. 6 shows a sectional view of a second embodiment of droplet deposition apparatus taken perpendicular to the direction of extension of the nozzle rows. Similar to the first embodiment shown in FIG. 3, the supporting structure 900 of the printhead incorporates ink flow passages 910,920 extending the width of the printhead. Ink enters the printhead and the ink supply passage 920 as shown at 915 in FIG. 6. As it flows along the passage, it is drawn off into respective ink chambers 925 via aperture 930 formed in structure 900. Having flowed through the ink chambers, ink exits via apertures 940 and 950 to join the ink flow along ink outlet passage 910 as indicated at 935.

A flat alumina substrate 960 is mounted to the structure 900 via alumina interposer layer 970. The interposer layer 970 is preferably bonded to the structure 900 using thermally conductive adhesive, approximately 100 microns in thickness, the substrate 960 being in turn bonded to the interposer layer 970 using thermally conductive adhesive.

Chips 980 of the drive circuit are mounted on a low density flexible circuit board 985. To facilitate manufacture of the printhead, and reduce costs, the portions of the circuit board carrying the chips 980 are mounted directly on the surface of the alumina substrate 960. In order to avoid overheating of the drive circuit, other heat generating components of the drive circuit, such as resistors 990, are mounted in substantial thermal conduct with that part of the structure 900 acting as a conduit so as to allow a substantial amount of the heat generated by these components 990 during their operation to transfer via the conduit structure to the ink.

In addition to the alumina substrate and interposer layer, an alumina plate 995 is mounted to the underside of the structure 900 in order to limit expansion of the aluminium structure 900 at this position, thereby substantially preventing bowing of the structure due to thermal expansion.

Each feature disclosed in this specification (which term includes the claims) and/or shown in the drawings may be incorporated in the invention independently of other disclosed and/or illustrated features.

What is claimed is:

1. Droplet deposition apparatus comprising:

a fluid chamber having an actuator actuable by electrical signals to effect ejection of droplets from the fluid chamber through a nozzle;

a drive circuit for supplying the electrical signals to the actuator mans; and a conduit for conveying droplet fluid to and from said fluid chamber, said drive circuit being in substantial thermal contact with said conduit so as to transfer a substantial part of the heat generated in said drive circuit to said droplet fluid.

2. Apparatus according to claim 1 comprising a first conduit for supplying droplet fluid to said fluid chamber and a second conduit for leading droplet fluid from said fluid chamber.

3. Droplet deposition apparatus comprising:

a fluid chamber having an actuator actuable by electrical signals to effect ejection of droplets from the fluid chamber through a nozzle;

a drive circuit for supplying the electrical signals to the actuator; and a conduit for conveying droplet fluid to and from said fluid chamber, said drive circuit being in substantial thermal contact with said conduit so as to transfer a substantial part of the heat generated in said drive circuit to said droplet fluid;

where said conduit comprising a first conduit for supplying droplet fluid to said fluid chamber and a second conduit for leading droplet fluid from said fluid chamber;

wherein said drive circuit means is thermally connected to the second conduit.

4. Droplet deposition apparatus comprising:

a fluid chamber having a actuator actuable by electrical signals to effect ejection droplets from the fluid chamber through a nozzle; and a drive circuit for supplying the electrical signals to the actuator; said device circuit means in substantial thermal contact with said conduit so as to transfer a substantial part of the heat generated in said drive circuit to said droplet fluid;

wherein the drive circuit is incorporated within an integrated circuit package of substantially cuboid form in which at least some of the faces of which are rectangles each having a surface area, a face other than that face having the smallest surface area being arranged so as to lie substantially parallel to the direction of fluid flow in that part of the conduit closest to said face, and to be in substantial thermal contact with the fluid.

5. Apparatus according to claim 4, wherein the face having the greatest surface area is arranged so as to lie parallel to the direction of fluid flow.

6. Droplet deposition apparatus comprising:

at least one droplet ejection unit comprising a plurality of fluid chambers, an actuator and a plurality of nozzles arranged in a row, said actuator being actuable to eject a droplet of fluid from a fluid chamber through a respective nozzle; and a support member for said at least one droplet ejection unit, said support member comprising at least one droplet fluid passageway communicating with said plurality of fluid chambers and arranged so as to convey droplet fluid to or from said fluid chambers in a direction substantially parallel to said nozzle row and to transfer a substantial part of the heat generated during droplet ejection to said convenyed droplet fluid.

7. Apparatus according to claim 6, wherein the droplet fluid passageway occupies the majority of the cross-sectional area of the support member.

8. Apparatus according to claim 6, wherein the droplet fluid passageway comprises respective portions for conducting droplet fluid into and away from each fluid chamber.

9. Apparatus according to claim 6, wherein the cross-section of support member is wider in the direction of ink ejection from the nozzles than in the direction of the nozzle row.

10. Apparatus according to claim 6, wherein the support member comprises material having a higher thermal conductivity than said at least one droplet ejection unit.

11. Apparatus according to claim 10, comprising means for attaching said at least one droplet ejection unit to the support member in order to substantially avoid transferal of thermal deformation of the support member to said at least one droplet ejection unit.

12. Apparatus according to claim 6, comprising a plurality of said droplet ejection units, the support member supporting the droplet ejection units side by side in the direction of the nozzle rows, the support member comprising at least one droplet fluid passageway communicating with at least two of said ejection units and arranged so as to convey droplet fluid to or from said ejection units in a direction substantially parallel to said nozzle rows and to transfer a substantial part of the heat generated during droplet ejection to said conveyed droplet fluid.

13. Droplet deposition apparatus comprising:

a fluid chamber, at least part of which is formed from a first material having a first coefficient of thermal expansion, said chamber being associated with an actuator actuable to eject a droplet from the chamber and having a port for the inlet of droplet fluid thereto;

a support member for said fluid chamber and including a passageway for supply of droplet liquid to said port, the support member being defined at least in part by a second material having a second coefficient of thermal expansion greater than said first coefficient; and means for attaching the fluid chamber to the support member in order to substantially avoid transfer of thermal deformation of the support member to said fluid chamber.

14. Apparatus according to claim 13, wherein the attachment means comprises resilient bonding means for bonding the fluid chamber to the support member.

15. Apparatus according to claim 13, wherein the or each fluid chamber comprises a channel formed in a body of piezoelectric material and closed by a cover member substantially thermally matched to the piezoelectric material.

16. Apparatus according to claim 15, wherein ink supply ports are formed in said cover.

17. Apparatus according to claim 15, wherein at least one ink ejection nozzle is formed in said body of piezoelectric material.

* * * * *